US006848893B2

(12) United States Patent
Tarng et al.

(10) Patent No.: US 6,848,893 B2
(45) Date of Patent: Feb. 1, 2005

(54) COMPRESSOR CHECK VALVE

(75) Inventors: Guang-Der Tarng, Taoyuan Hsien (TW); Lung-Tsai Chang, Taoyuan Hsien (TW)

(73) Assignee: Rechi Precision Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/342,216

(22) Filed: Jan. 15, 2003

(65) Prior Publication Data

US 2004/0136851 A1 Jul. 15, 2004

(51) Int. Cl.[7] ..... F01C 1/063; F16K 21/10

(52) U.S. Cl. ..... 417/507; 417/559; 418/55.1; 137/514; 137/514.3

(58) Field of Search ..... 417/507, 312, 417/309, 310, 311, 440, 559; 137/513, 329.1, 329.2, 514, 514.3; 418/270, 55.1, 555.1

(56) References Cited

U.S. PATENT DOCUMENTS 5,494,422 A * 2/1996 Ukai et al. ..... 418/55.1
6,132,191 A * 10/2000 Hugenroth et al. ..... 418/55.1
6,390,792 B1 * 5/2002 Tarng et al. ..... 418/55.1
6,457,952 B1 * 10/2002 Haller et al. ..... 417/410.5
6,659,735 B2 * 12/2003 Kim ..... 417/310
6,672,845 B1 * 1/2004 Kim et al. ..... 417/310
6,685,441 B2 * 2/2004 Nam ..... 417/292

FOREIGN PATENT DOCUMENTS

KR 332776 B * 4/2002 ..... F04C/18/02

* cited by examiner

*Primary Examiner*—Charles G. Freay
(74) *Attorney, Agent, or Firm*—Troxell Law Office PLLC

(57) ABSTRACT

A compressor check valve having a valve bolt and a valve bolt cover for noise reduction and mitigation of impact from a valve bolt on the valve bolt cover. A bolt insertion hole is provided in the cover to receive the valve bolt. A pressure conduction hole penetrating from the side of the valve bolt insertion hole of the cover through the exterior of the cover is provided on the cover to connect the high pressure chamber through the valve bolt insertion hole. A buffer section is formed on a top of the valve bolt insertion hole so that the valve bolt is forced by a high pressure coolant to move above and block the pressure conduction hole, the buffer section contains high pressure coolant prevented from being discharged through the pressure conduction hole to create a buffer action when the valve bolt moves upward so as to avoid direct impact against the valve bolt cover.

5 Claims, 5 Drawing Sheets

COMPRESSOR CHECK VALVE

BACKGROUND OF THE INVENTION (a) Field of the Invention

The present invention is related to an improved structure of a compressor check valve, and more particularly, to one that provides buffer action to the rise of the valve bolt to help reduce noise and extend service life of the check valve.

(b) Description of the Prior Art

As illustrated in FIG. 1 of the accompanying drawings, a turbo compressor (A) is essentially comprised of a revolving turbo (A2), a fixed turbo (A1), a separation base (B) and a drive unit (C). Within, the upper and the lower closed space inside the compressor (A) is divided into a low pressure chamber (R1) and a high-pressure chamber (R2) by the separation base (B). A coolant inlet (A3) and a coolant outlet (A4) are respectively provided on one side of the LP chamber (R1) and the HP chamber (R2). Meanwhile, a fixed turbo (A1) and a revolving turbo (A2) are provided below the separation base (B) on one side of the LP chamber (R1). The revolving turbo (A2) as driven by the drive unit (C) to revolve around instead of revolving on inside the fixed turbo (A1) so to change the space between the fixed turbo (A1) and the revolving turbo (A2), and further to change the volume of the coolant by sucking in and compressing the coolant entering into the LP chamber (R1) for allowing the high pressure coolant flow through a ventilation pore (B1), and a coolant outlet (A4) into the coolant pipe to complete thermal cycle between the coolant pipe and the compressor. Whereas, both sides of the separation base (B) relate to high-pressure end and low-pressure end, a check valve (B2) must be provided at the ventilation pore (B1) of the separation base (B) to prevent coolant in the HP chamber (R2) from flowing back to the LR chamber (R1). However, the check valve (B2) generally used for the compressor is available in the form of valve gate, it when failing to slide down to block the passage will cause the high pressure coolant to flow back, thus resulting in noise. Furthermore, for a check valve comprised of a valve rod provided between a separation base and a valve-cover, the lower edge of the valve rod is directly holding against the end surface of the separation base to avoid the high-pressure coolant from fast flowing back to the low-pressure side. However, while its revolving turbo and its fixed turbo are operating in relation to each other, the coolant is compressed into the high-pressure chamber to create pulsation. Accordingly, the check valve indicates instable impacts up and down to create extremely high level of abnormal noise.

SUMMARY OF THE INVENTION

The primary purpose of the present invention is to provide an improved structure of a check valve for a compressor for noise reduction. To achieve the purpose, the present invention is comprised of a valve bolt and a valve bolt cover. Wherein, the valve bolt cover is provided with an insertion hole to receive the insertion of the valve bolt and a pressure conduction hole is provided on the cover to connect the high-pressure chamber to the valve bolt insertion hole. The pressure conduction hole penetrates through the exterior of the valve bolt cover by the side of the valve bolt insertion hole. A buffer section is formed on the top of the valve rod insertion hole to be filled up with high-pressure coolant so to be prevented from discharging out of the pressure conduction hole when the valve bolt is plunged by the high pressure coolant to rise to the high pressure conduction hole and blocked by the body of the valve bolt. It creates a buffer action to the rise of the valve bolt for the valve bolt to avoid direct impact against the valve bolt cover, thus to achieve the purpose of noise reduction.

Another purpose of the present invention is to provide an improved structure of a check valve for a compressor to avoid extremely high level of abnormal sound by pulsation reduction. To achieve the purpose, the valve bolt drops due to gravity when the compressor is not operating. When the valve descends beyond the pressure conduction hole, the coolant in the high pressure chamber is guided through the pressure conduction hole to the buffer section on the top of the valve bolt to push the valve bolt to the ventilation pore of the separation base and the bottom of the valve bolt covers up the ventilation pore so to block the coolant from flowing back into the lower pressure chamber to reduce the pulsation.

Another purpose yet of the present invention is to provide an improved structure of a check valve for a compressor that reduces the noise generated by the impact of the coolant. To achieve the purpose, an arc conduction angle is formed on the circumference of the ventilation pore of the separation base for the angle and the end surface of the valve rod to guide smooth release of the coolant.

DETAILED DESCRIPTION OF THE PREFERRED EMBODIMENTS

The present invention relates to an improved structure of a check valve for a compressor. The upper and the lower closed space inside the compressor are divided into a low-pressure chamber and a high-pressure chamber by means of a separation base. A coolant inlet and a coolant outlet are respectively on provided on the side of the low pressure and the high-pressure chambers. A fixed turbo and a revolving turbo are provided below the separation base by the low-pressure chamber. The revolving turbo is driven by a drive unit to operate in the fixed turbo for the high-pressure coolant to flow through a ventilation pore of the separation base into the high-pressure chamber and leave the coolant outlet into the coolant pipe. The check valve is provided at the ventilation pore of the separation for the coolant to enter from the low pressure chamber into the ventilation pore of the high pressure chamber so to restrict the coolant from flowing in one way, thus to make sure that the coolant is stored under pressure in the high pressure chamber before allowing a proper amount of coolant to be released through the coolant outlet into the coolant pipe.

Figure 1:
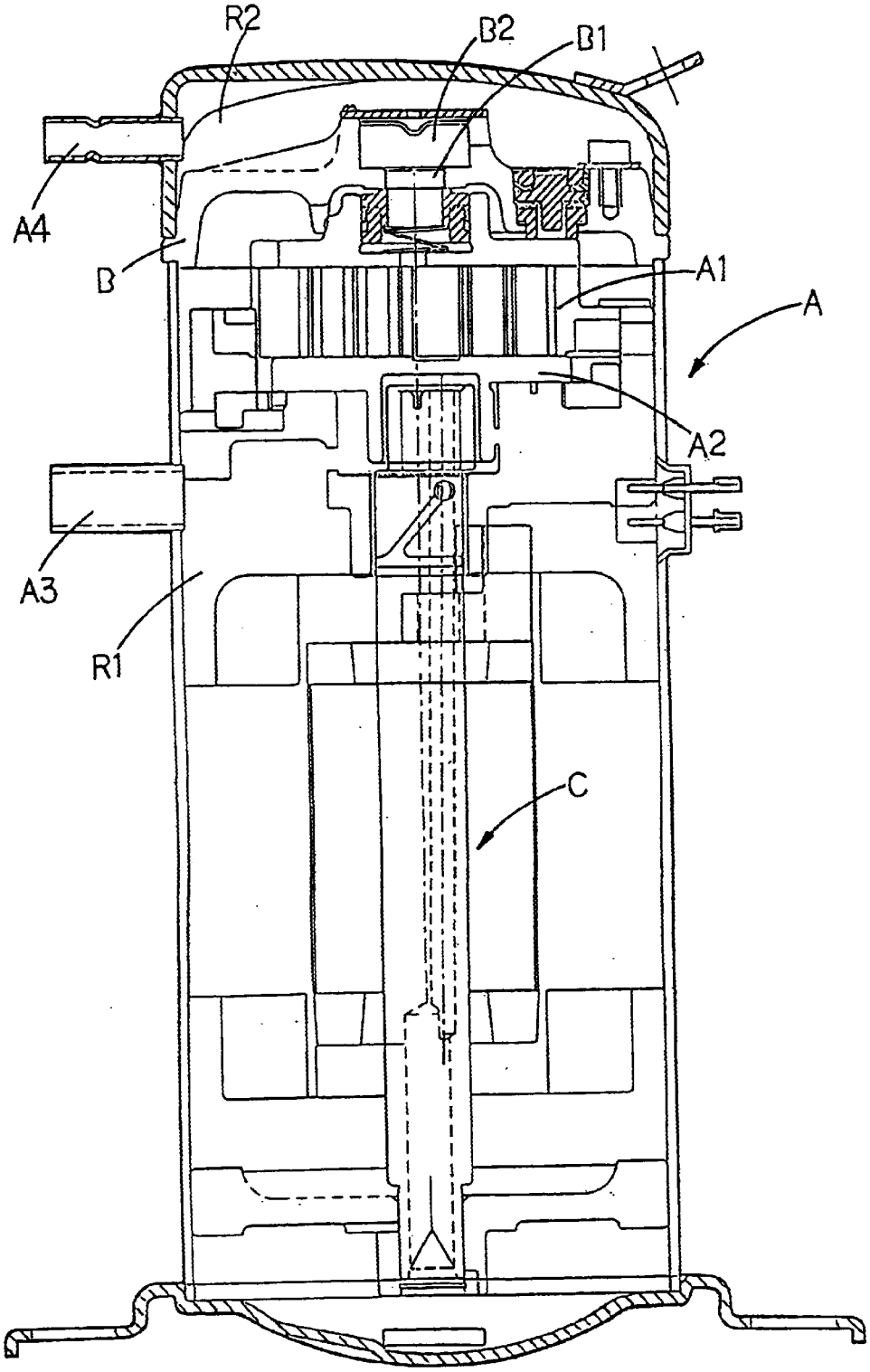
FIG.1 Prior Art
FIG. 1 is a schematic view of a turbo compressor.
Figure 2:
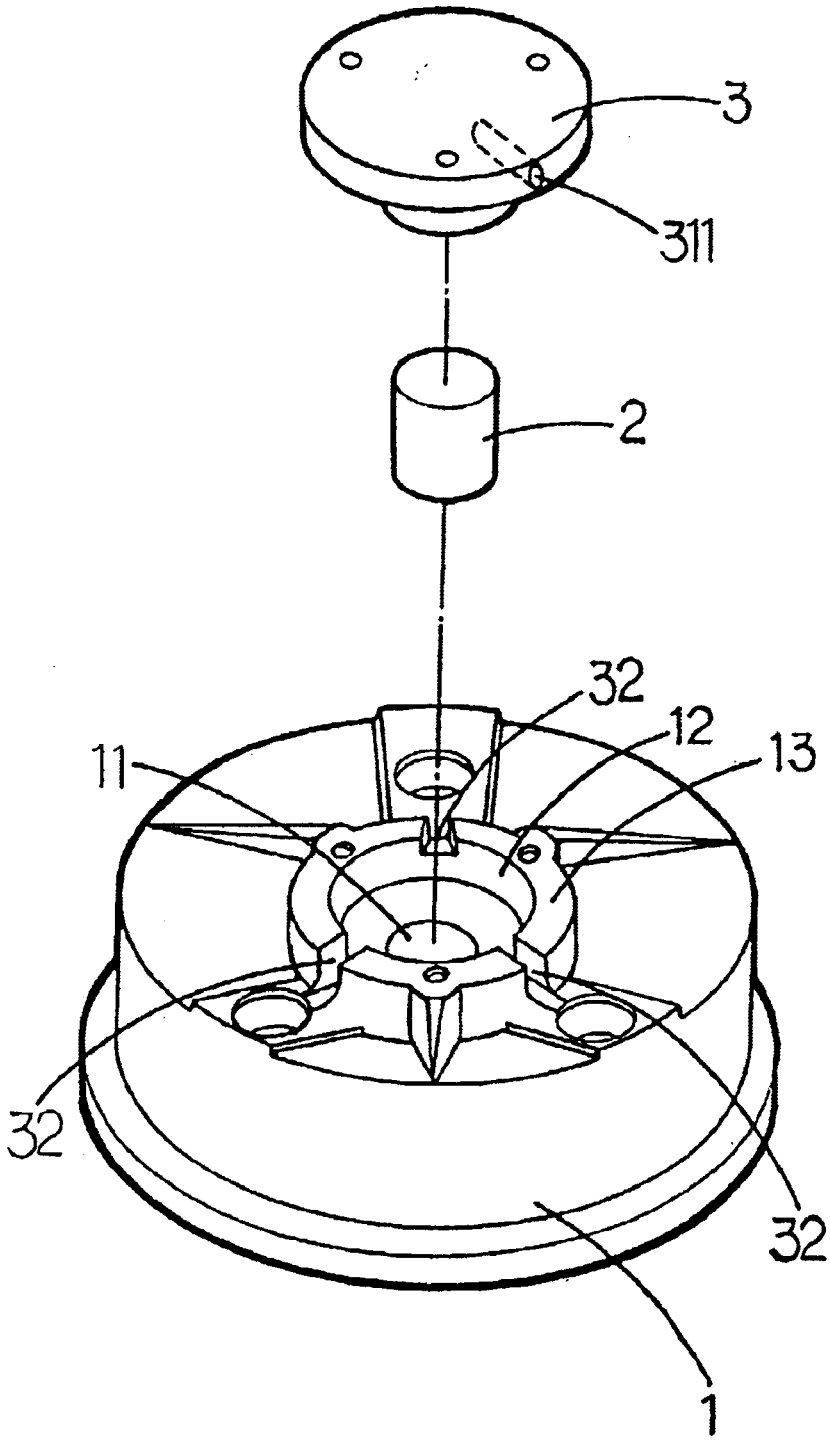
FIG. 2 is an exploded view of a preferred embodiment of the present invention.
Figure 3:
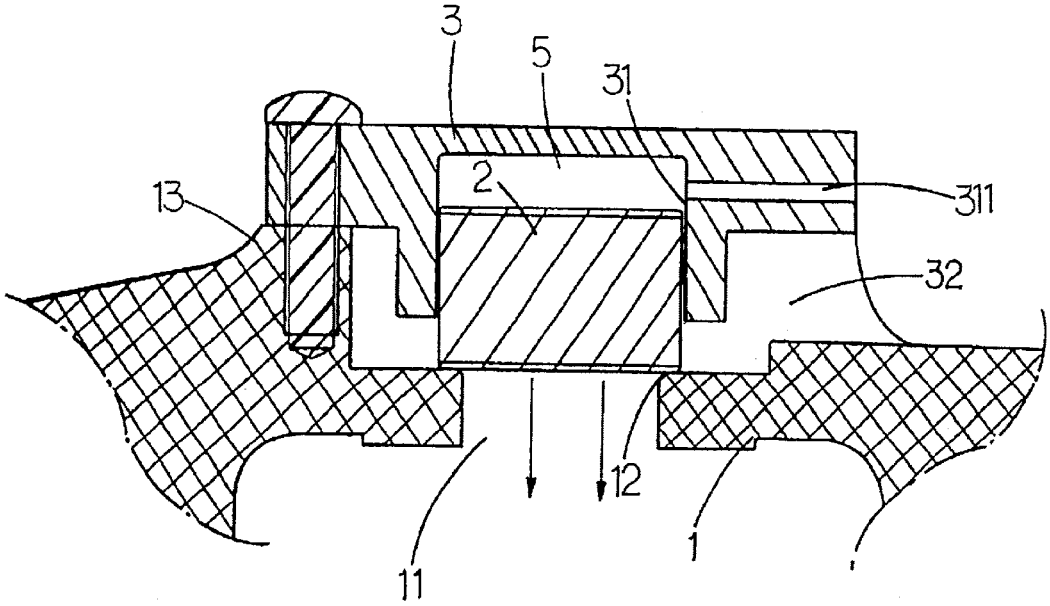
FIG. 3 is a sectional view of the preferred embodiment of the present invention.
Figure 4:
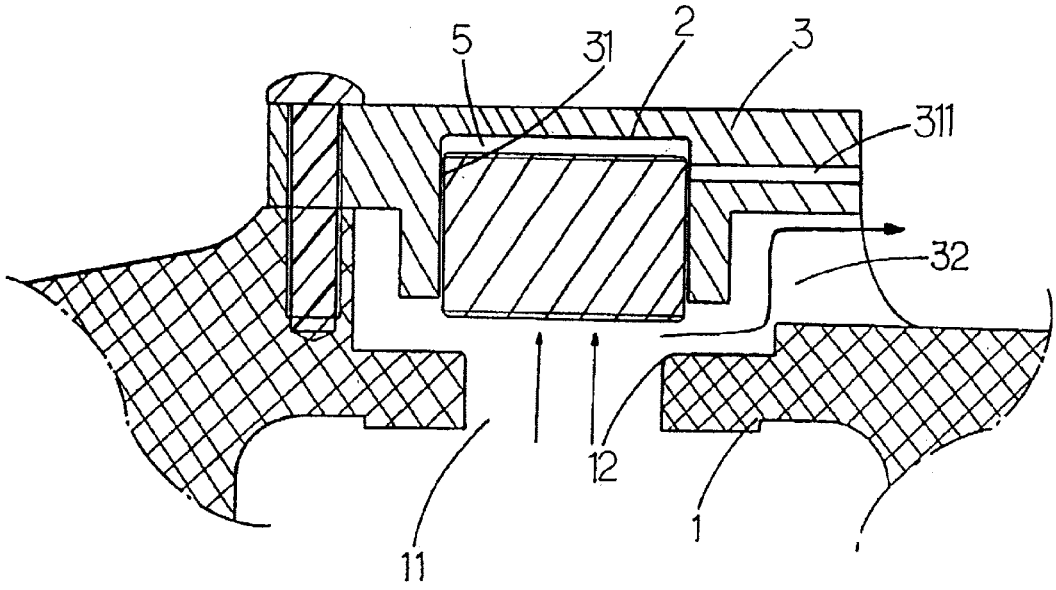
FIG. 4 is a sectional view showing a rising valve bolt in the preferred embodiment of the present invention.

Referring to FIGS. 2 and 3, a check valve of a preferred embodiment of the present invention is essentially comprised of a valve bolt (2) and a valve bolt cover (3) adapted with a separation base (1). Within, the valve bolt cover (3) is provided with a valve bolt insertion hole (31) to receive insertion of the valve bolt (2). A pressure conduction hole (311) is provided on the cover (3) to connect a high pressure chamber (R2) through the valve bolt insertion hole (31) for the high pressure coolant to flow through the pressure conduction hole (311) into a buffer section (5) formed between the valve bolt cover (3) and the valve bolt (2). A passage (32) to drain the coolant is provided on where the valve bolt cover (3) is attached to the separation base (1) so that when the revolving turbo and the fixed turbo of the compressor are operating in relation to each other as illustrated in FIG. 4, the high pressure coolant forthwith plunges against and elevates the valve bolt (2) to allow the high pressure coolant enter through the passage (32) into the high pressure chamber (R2). The pressure conduction hole (311) connects from the side of the valve bolt insertion hole (31) of the valve cover (3) through the exterior of valve bolt cover (3) to form the buffer section (5) with the top of the valve bolt insertion hole (31). Consequently, when the valve bolt (2) being subject to the plunge by the high pressure coolant rises up to the pressure conduction hole (311) and is blocked by the body of the valve bolt (2), the buffer section (5) on top of the valve bolt (2) is filled up with high pressure coolant and the coolant is prevented from being discharged through the pressure conduction hole (311). In turn the high pressure coolant creates a buffer action on the rise of the valve bolt (2) for the valve bolt (2) to avoid direction impact against the valve bolt cover (3) to achieve the purpose of noise reduction. Meanwhile, the reduced impact for the valve bolt (2) against the valve bolt cover (3) extends the service life of the check valve. Once the compressor is not operating, the valve bolt (2) falls due to gravity. When the valve bolt (2) descends beyond the pressure conduction hole (311), the coolant in the high pressure chamber is guided through the pressure conduction hole (311) to reach the buffer section (5) on top of the valve bolt (2) as illustrated in FIG. 3 to push the valve rod (2) towards the ventilation pore (11), of the separation base (1). Meanwhile, the bottom of the valve bolt (2) covers up the ventilation pore (1) to block the coolant from entering into the low pressure chamber (R1) thus to reduce the pulsation, and the extremely higher level of abnormal noise created by the pulsation.

The separation base (1) is directly formed in the configuration of the fixed turbo and the ventilation pore (11) is provided at the center of the separation base (1). The check valve is provided on the circumference of the ventilation pore an arc guide angle (12) and a valve bolt cover insertion base (13) is provided on the separation base (1) at where the ventilation pore takes a turn onto the surface of the separation base (1) to hold the valve bolt cover (3) in position to hold firm the structure of the entire check valve. A passage (32) is provided on the wall of the valve bolt cover insertion base (13) for the coolant as led by the arc guide angle (12) to enter through the passage (32) into the high pressure chamber when the valve bolt (2) rises when plunged by the high-pressure coolant. Consequently, the pulsation created when the coolant is compressed to enter into the high-pressure chamber while the coolant is evenly drained through the passage (32) to help stabilize the direction of the coolant flowing into the high-pressure chamber.

Figure 5:
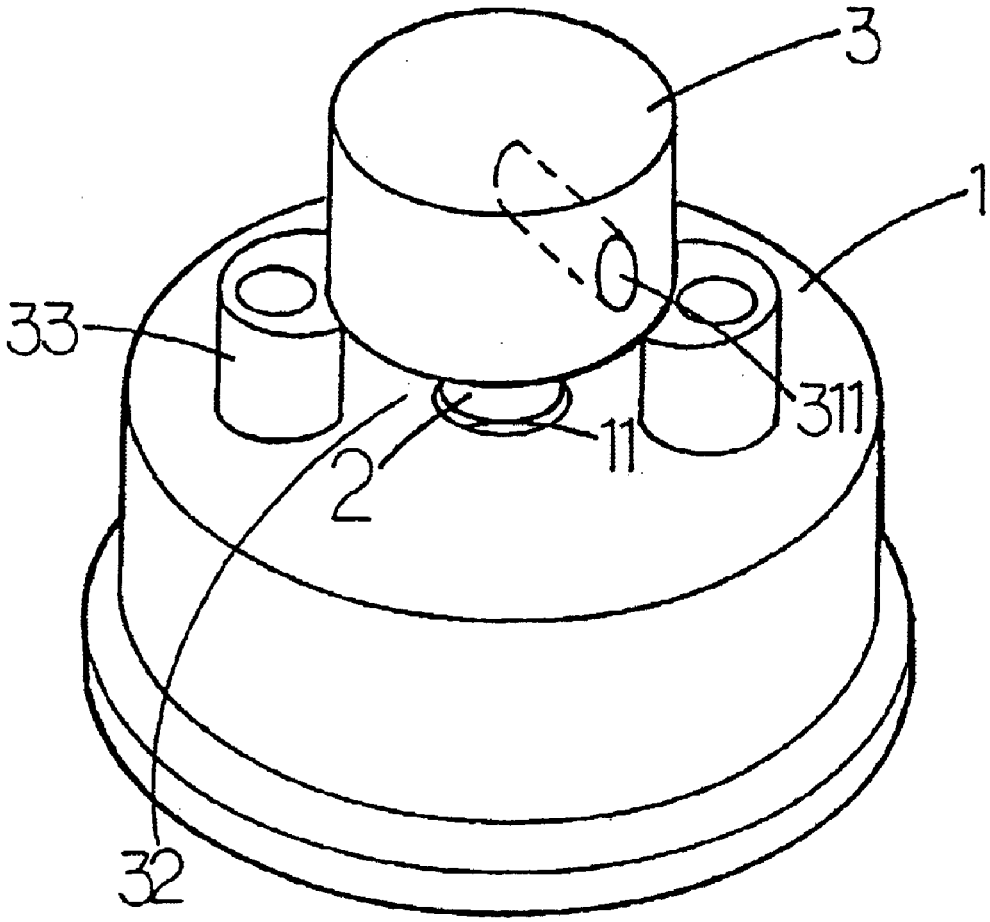
FIG. 5 is a perspective view of another preferred embodiment of the present invention.

Furthermore, the check valve of the present invention may be directly adapted to the fixed turbo (A1). The ventilation pore (11) is formed at the center fo the fixed turbo (A) and the valve bolt cover insertion base (13) is formed to the outer circumference of the ventilation pore (11) to hold the valve bolt cover (3) in position. As illustrated in FIG. 5, a pad (33) is provided on the bottom of the valve bolt cover (3) to incorporate the valve bolt cover (3) to the separation base (1). The passage (32) is formed by the pad (33) to separate the bottom of the valve bolt cover (3) from the separation base (1) for the coolant to flow through the passage (32) into the high-pressure chamber.

The present invention by achieving noise reduction and extending the service life of the check valve provides an improved structure of the check valve; therefore, the application for a utility patent is duly filed.

We claim:

1. A check valve for a compressor having high and low pressure chambers and highly pressurized liquid, the check valve comprising:

a) a separation base located between the high and the low pressure chambers and having a ventilation pore;

b) a valve bolt cover connected to the separation base and having:

i) a valve bolt insertion hole communicating with the ventilation pore;

ii) a pressure conduction hole located in a side of the valve bolt insertion hole and communicating with an exterior of the valve bolt cover, the pressure conduction hole being spaced apart from a top of the valve insertion hole; and iii) a buffer section being a portion of an interior of the valve bolt insertion hole between the pressure conduction hole and the top of the valve insertion hole;

c) a passage located between the separation base and the valve bolt cover; and d) a valve bolt inserted into the valve bolt insertion hole and movable between a first position and a second position, wherein:

i) in the first position, the valve bolt is located adjacent to the separation base sealing the ventilation pore and highly pressurized liquid flows into the buffer section via the pressure conduction hole and ii) in the second position, the valve bolt is spaced apart from the separation base and seals the pressure conduction hole, highly pressurized liquid in the buffer section buffers impact between the valve bolt and the valve bolt cover, and highly pressurized liquid flows through the ventilation pore to the high pressure chamber via the passage.

2. The check valve according to claim 1, wherein the ventilation pore includes an arc guide angle on a circumference thereof.

3. The check valve according to claim 1, wherein the separation base includes a valve bolt cover insertion base connected to the valve bolt cover, the passage is located through the valve bolt cover insertion base.

4. The check valve according to claim 1, wherein the separation base connected to a fixed turbo of the compressor.

5. The check valve according to claim 1, further comprising a pad located on the valve bolt cover between the valve bolt cover and the separation base, the passage is located through the pad.

* * * * *